US006261069B1

(12) United States Patent
Djordjevic

(10) Patent No.: US 6,261,069 B1
(45) Date of Patent: Jul. 17, 2001

(54) SHAFT SEAL WITH PRESSURE EQUALIZING SHUTTLE

(75) Inventor: Ilija Djordjevic, East Granby, CT (US)

(73) Assignee: Stanadyne Automotive Corp., Windsor, CT (US)

( * ) Notice: Subject to any disclaimer, the term of this patent is extended or adjusted under 35 U.S.C. 154(b) by 0 days.

(21) Appl. No.: 09/520,521

(22) Filed: Mar. 8, 2000

(51) Int. Cl.[7] ..... F04B 23/00; F04B 39/00; F04B 53/00

(52) U.S. Cl. ..... 417/313; 137/493.3

(58) Field of Search ..... 417/313, 267, 417/213; 418/84; 123/447, 446; 137/135, 493.3; 239/88

(56) References Cited

U.S. PATENT DOCUMENTS 4,086,041 * 4/1978 Takada ..... 418/84
4,325,340 * 4/1982 O'Neill ..... 123/447
4,342,328 * 8/1982 Matta ..... 137/135
4,383,804 * 5/1983 Budzich ..... 417/267
4,926,902 * 5/1990 Nakamura et al. ..... 137/493.3
5,494,220 * 2/1996 Shinogle et al. ..... 239/88
5,800,130 * 9/1998 Blass ..... 417/213
5,894,830 * 4/1999 Blass et al. ..... 123/446

* cited by examiner

*Primary Examiner*—Sang Paik
*Assistant Examiner*—Leonid Fastovsky
(74) *Attorney, Agent, or Firm*—Alix, Yale & Ristas, LLP

(57) ABSTRACT

An apparatus is provided for equalizing pressure between a lubrication fluid for lubricating a pump and a combustion fluid located at a low pressure side of the pump wherein the pump has a rotatable shaft. The apparatus includes a wall defining a bore within the pump wherein a first end of the bore is configured to receive a lubrication fluid and a second end of the bore is configured to receive combustion fluid. An equalizing element is disposed within the bore for separating the lubrication fluid and the combustion fluid and may be at least partially movable in response to pressure differences caused, e.g., by differences in thermal expansion between the lubrication fluid and the combustion fluid.

24 Claims, 4 Drawing Sheets

SHAFT SEAL WITH PRESSURE EQUALIZING SHUTTLE

FIELD OF THE INVENTION

The present invention relates to pumps and, more particularly, to an apparatus for equalizing pressure between a lubrication fluid and a combustion fluid to be pressurized by a supply pump.

BACKGROUND OF THE INVENTION

Direct gasoline injection has some distinct advantages over prior art systems with respect to emissions and fuel economy of the engine, mainly because of an increase in the efficiency of the engine.

Currently, efforts are underway to develop a reliable and inexpensive pump capable of generating a relatively high pressure (such as 120 bar and higher) required for supplying a common rail system used in direct gasoline injection. One such pump is shown in U.S. patent application Ser. No. 09/031,859, filed Feb. 27, 1998 and entitled "Supply Pump for Gasoline Common Rail" (International Application No. PCT/US99/03830 published under International Publication No. WO 99/43949), which is assigned to the present assignee hereof and the entire contents of which is hereby incorporated herein by reference. This supply pump, as is typical of pumps in general, includes a rotating shaft having bearings that are lubricated by either a lubrication fluid (oil) or a combustion fluid (fuel) disposed on the low pressure side of the pump. The fuel may be pre-pressurized to 3 or 4 bar by a separate feed pump, e.g., remotely located in a fuel tank. Seals, such as lip seals, which extend radially about the rotating shaft, are employed to prevent escape and/or mixing of either fluid.

While the supply pump described in the International Publication is suitable for its intended purposes, a problem can occur with the supply pump in that because of the differences in pressure between the oil pressure and fuel pressure within the pump, the lip seals may be canted one way or the other into contact with the rotating shaft resulting in premature wear thereof.

Another problem can also arise because of the difference in pressure between the oil and the fuel. In particular, passage by either the oil or the fuel through the seal occurs, due to the canting of the seal and/or other factors, resulting in improper mixing of these fluids. In one direction, mixing of the fuel into the oil may result in a reduction in lubricity of the oil. It will be appreciated that reduced lubricity of the oil can, for example, result in premature wear of the pump and possibly other systems of the engine. Also, potential hazardous waste problems concerning disposal of the oil/fuel mixture may arise. In the opposite direction, the mixing of the oil with the fuel may result in a reduction in engine performance.

SUMMARY OF THE INVENTION

It is, accordingly, an object of the present invention to provide an apparatus which equalizes pressure within a pump between a lubrication fluid and a combustion fluid disposed at a low pressure side of the pump.

It is another object to provide such an apparatus which can adjust the pressure of the lubrication fluid to slightly above that of the combustion fluid.

It is a further object of the invention to provide a pump for supplying a common rail gasoline fuel injection system for a multi-cylinder internal combustion engine.

According to one aspect of the present invention, an apparatus is provided for equalizing pressure between a first region of lubrication fluid for lubricating a pump and a second region of combustion fluid at a low pressure where the pump has a rotatable shaft. The apparatus comprises a wall defining a bore disposed within the pump where the first end of the bore is configured to receive lubrication fluid from the first region and a second end of the bore is configured to receive combustion fluid from the second region. An equalizing element is also provided which is disposed within the bore for separating the lubrication fluid and the combustion fluid. The shuttle is at least partially moveable in response to pressure differences between the first region and the second region generated by changes in volume caused for example by thermal expansion.

In a particular aspect of the invention the equalizing element may comprise either a shuttle or a diaphragm. Means may be provided for biasing the shuttle so as to increase the pressure of the lubrication fluid in the first region relative to the combustion fluid in the second region. The rotating shaft may include a recess which communicates with the bore and the bias means may comprise a coil spring. The coil spring may have an enlarged diameter portion at one end thereof, which may be disposed within the recess of the rotating shaft.

In another aspect at least one seal is disposed on the shuttle which may comprise a pair of lip seals disposed at opposing ends of the shuttle. Optionally, the shuttle may include a pair of recesses laterally spaced along a longitudinal axis of the shuttle and the at least one seal may comprise two O-rings, each of which are disposed within a respective recess of the shuttle. The axial length of the bore and the spacing of the recesses of the shuttle may also be dimensioned such that during movement of the shuttle each respective O-ring engages only that portion of the bore in contact with a respective lubrication fluid or combustion fluid. The shuttle may also be generally cylindrical in shape.

In a further aspect, the pump may comprise a pump housing and the rotatable shaft may be disposed within a pump cavity of the pump housing. A first bearing and a second bearing may be interposed between the rotatable shaft and the pump housing. The first bearing may be in contact with the lubrication fluid and the second bearing may be in contact with the combustion fluid. The first and second bearings may comprise needle bearings or, optionally, the first bearing may comprise a ball bearing and the second bearing may comprise a wet bushing.

In a still further aspect, the rotatable shaft has an external profile and the pump may supply the combustion fluid at a relatively high pressure to a common rail and the pump may further comprise the following. At least one shoe means in sliding engagement with the external profile of the rotatable shaft. Retention means for urging the shoe means against the external profile of the rotatable shaft during rotation thereof. At least one pumping plunger disposed in a plunger bore and being in operative engagement with the shoe means. Each of the plungers having radially outer and inner ends relative to the axis and an internal charging passage which opens toward the cavity at the inner end of the plunger and opens towards the outer end of the plunger bore at the outer end of the plunger. The shoe means sliding on the external profile which is configured for providing reciprocal movement of the plungers. A discharge passage from the outer end of the plunger bore into the housing, and a discharge check valve in the discharge passage for permitting flow only away from the plunger bore. The discharge passage communicating with the common rail such that reciprocation of each plunger includes movement toward an inner limit position for inducing low pressure in the outer end of the plunger bore, thereby drawing combustion fluid in a charging phase of operation from the pump cavity through charging passage into the outer end of the plunger bore, and movement toward an outer limit position for developing a high pressure in the outer end of the plunger bore thereby discharging combustion fluid through the discharge check valve into the common rail in a discharging phase of operation.

In a still further aspect the charging passage includes a charging check valve which is normally closed at the inner end, but which opens to permit flow from the inner to the outer end of the plunger during the charging phase of operation. The lubrication fluid may comprise a lubricating oil and the combustion fluid may comprise gasoline.

In another aspect of the invention an apparatus is provided for equalizing pressure disposed between a lubrication fluid for lubricating a pump and a combustion fluid disposed at a low pressure side of the pump. The apparatus comprises a wall defining a bore disposed within the pump drive shaft, where the first end of the bore is configured to receive lubrication fluid and a second end of the bore is configured to receive combustion fluid. A shuttle is be disposed within the bore for separating the lubrication fluid and the combustion fluid and being movable, for example, in response to differences in thermal expansion between the lubrication fluid and the combustion fluid.

In yet a further aspect of the invention, in a pump for receiving combustion fluid at low pressure and supplying combustion fluid at high pressure, an apparatus is provided for equalizing pressure between a first region of lubrication fluid for lubricating the pump and a second region of combustion fluid at a low pressure where the pump has a rotatable shaft. The apparatus comprises wall means defining a bore disposed within the rotatable shaft, a first end of said bore being configured to receive lubrication fluid from said first region and a second end of said bore being configured to receive combustion fluid from said second region and a shuttle disposed within said bore, said shuttle being configured to equalize pressure between the first region and the second region.

In a further aspect of the invention means are provided for biasing said shuttle against the lubrication fluid in the bore so as to increase the pressure of the lubrication fluid in the first region relative to the combustion fluid in the second region.

In still a further aspect a seal is disposed about the rotatable shaft, wherein said seal is disposed between the first region and the second region.

In another aspect, the first region comprises a chamber defined between the shuttle and a closed end of said bore and a passage communicating with said chamber at one end, passing through the shaft and communicating at the other end with one side of said seal. The second region comprises a main cavity which communicates with a second side of said seal.

DETAILED DESCRIPTION OF THE PREFERRED EMBODIMENTS

Figure 1:
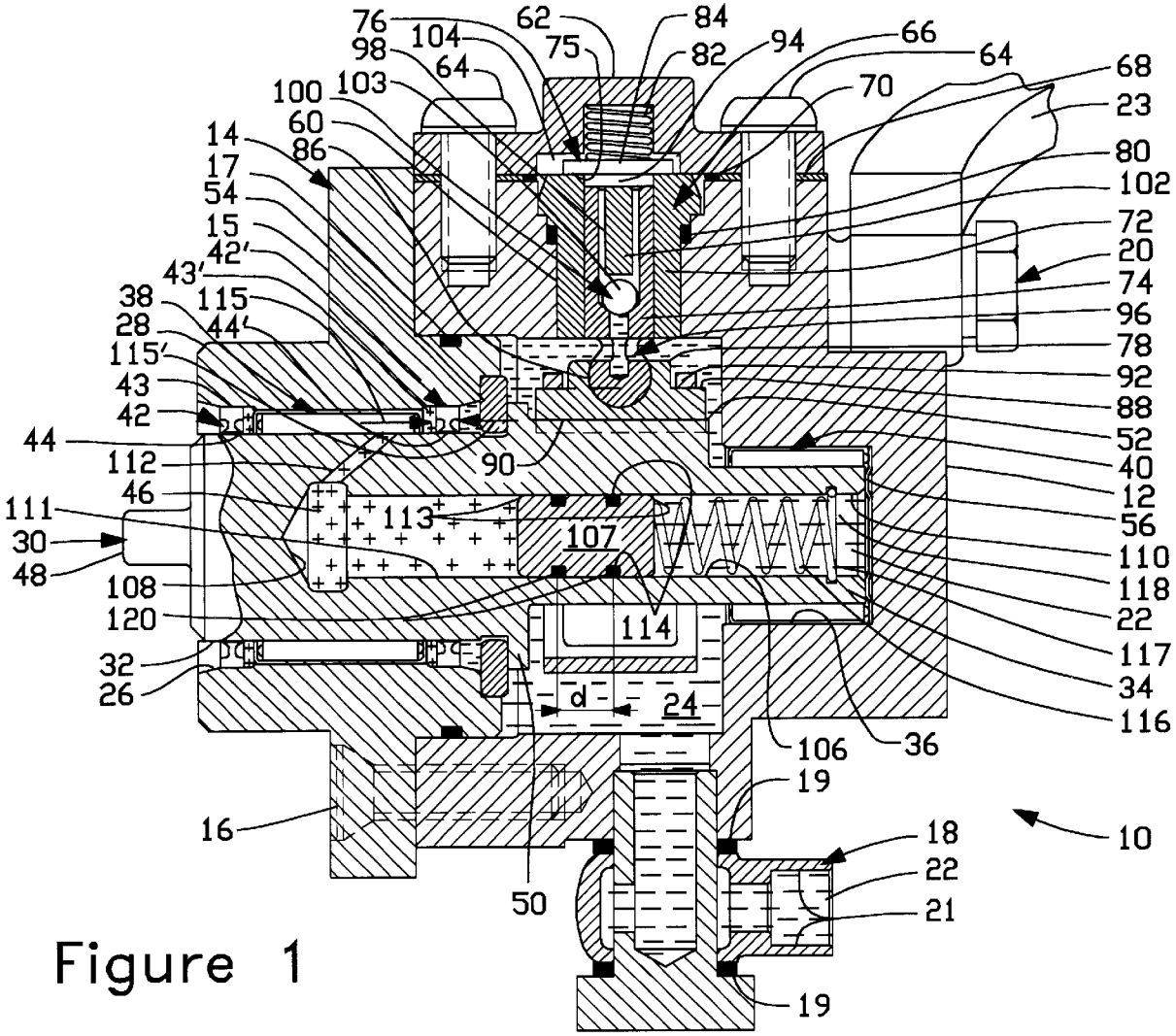
FIG. 1 is a cross sectional view of a pump having a needle bearing scheme and employing a pressure equalizing shuttle in accordance with one embodiment of the present invention.

Referring to FIG. 1, a pump in accordance with a first embodiment of the present invention is shown generally at 10. The pump comprises a housing 12 and a flanged sleeve 14 each of which may be composed of, for example, aluminum or steel and may be cast in a well known manner. The flanged cover 14 includes a flange 15 for mounting to the housing 12 via suitable fasteners 16 (shown in dotted line). O-ring 17 is provided for sealing engagement between the flanged cover 14 and housing 12.

The housing 12 includes fuel inlet connector 18 and an outlet connector 20. The inlet connector 18 is sealed, e.g., by copper washers 19 and includes a bore 21 which receives a combustion fluid or fuel 22, such as gasoline from a fuel tank (not shown) pressurized by a low pressure feed pump (also not shown) at a feed pressure in the range of 2–5 bar, preferably in the range of 3–4 bar. The outlet connector 20 is connected to a common rail 23 and passes pressurized fuel thereto for injection into, e.g., an internal combustion engine (not shown).

The housing 12 defines a main cavity 24 which is closed by the flanged cover 14. The main cavity 24 communicates with the bore 21 of the inlet connector 18 and indirectly with the outlet connector 20 for passage of fuel through the pump 10.

The flanged cover 14 includes a central aperture 26 defined by a sleeve 28. A rotating shaft 30 is supported by the sleeve 28 at a first end 32 and at a second end 34 within a recess 36 of the housing 12. A first bearing 38 is interposed between the rotating shaft 30 and the sleeve 28. A second bearing 40 is interposed between the second end 34 of the rotating shaft 30 and the recess 36 of the housing 12. It will be understood that either or both the first and second bearings 38, 40 may comprise any suitable bearing such as a needle bearing as illustrated. The first bearing 38 is provided with seals 42, 42' which may comprise lip seals as illustrated where each has a base portion 43, 43' and inwardly extending lip portions 44, 44'. The seals 42, 42' function to prevent loss of lubricating fluid such as oil 46 and the mixing of oil 46 and fuel 22 as will be discussed in more detail hereafter.

The rotating shaft 30 may be composed of any suitably strong and durable material such as a steel and includes a tang 48, flange 50 and an eccentric profile 52. The tang 48 is provided for connection with a suitable device for imparting a rotational force to the rotatable shaft 30. The flange 50 abuts a thrust washer 54 which in combination with a bottom thrust plate 56 prevents excessive axial movement of the rotatable shaft 30.

The eccentric profile 52 of the rotatable shaft 30 is disposed within the main cavity 24 and defines an outer surface which is eccentric with respect to the longitudinal axis of the rotatable shaft 30. It will be understood that the rotatable shaft 30 has a portion of the shaft (not shown) which is offset from the longitudinal axis. Further details of a rotatable shaft having an offset portion may be unberstood with reference to U.S. patent application Ser. No. 09/031, 859 entitled "Supply Pump for Gasoline Common Rail" filed Feb. 27, 1998, the entire contents of which has previously been incorporated herein by reference.

The housing 12 includes at least one bore 60 which communicates at one end with the main cavity 24 and at the other end with the outlet connector 20 via internal discharge passages (not shown). A cover 62 and fasteners 64 are provided to enclose a plunger assembly 66 which is disposed within the bore 60. The cover 62 may also include a spacer 68 and a suitable seal such as an O-ring 70.

Plunger assembly 66 comprises a sleeve 72, pumping plunger 74, pumping chamber 75, check valve 76 and shoe 78. The sleeve 72 mates with the bore 60 and is sealed by an O-ring 80 to prevent migration of combustion fluid 22 from a high pressure side of check valve 76 into the main cavity 24.

The check valve 76 comprises a spring 82 and plate 84 which is sealingly engageable with an upper surface (not numbered) of the sleeve 72 and communicates with the outlet connector 20.

The shoe 78 comprises a cradle 86, engagement shoulders 88 and engagement surface 90. The cradle 86 is configured to receive the pumping plunger 74 and the engagement surface 90 is configured to mate with the eccentric profile 52 of the rotatable shaft 30. The engagement shoulders 88 contact an energizing cage 92 which retains the shoe adjacent the rotatable shaft 30

The pumping plunger 74 is disposed within the sleeve 72 and comprises an outer end 94 and inner end 96 between which is a charging passage 98 and a check valve 100. Check valve 100 includes a ball stop 102 and a ball 103.

In operation, as the shaft 30 rotates through one revolution the shoe 78 remains in contact with the eccentric profile 52, whereby the pumping plunger 74 is reciprocated toward an inner limit position, which produces a low pressure in the pumping chamber 75, to an outer limit position for developing a high pressure in the pumping chamber. In a somewhat conventional manner, highly pressurized fuel in the pumping chamber 75 is discharged through a discharge check valve 76 into a discharge passage 104 which, in turn, fluidly communicates with the outlet connector 20 and common rail 23.

It will be understood that while a single pumping plunger is illustrated, multiple plungers would typically be employed in the practice of this invention, for example, in the form of a radial multiple chamber pump.

For a further detailed discussion of the operation of a supply pump suitable for practice in conjunction with the present invention, reference may be had to U.S. patent application Ser. No. 09/031,859 entitled "Supply Pump for Gasoline Common Rail" filed Feb. 27, 1998, discussed above.

In accordance with a feature of the present invention, the rotatable shaft 30 is provided with a longitudinal bore 106 having an equalizing element, in this embodiment, a shuttle 107 disposed therein between a closed end 108 and an open end 110. The open end 110 fluidly communicates with the main cavity 24 such that fuel 22 may flow therebetween. A transfer passage 112 is disposed in fluid communication with the closed end 108 for supplying oil 46 to/from the bearing 38 from/to a chamber 111 defined between the shuttle 107 and closed end 108.

In the preferred embodiment, the oil 46 is introduced during assembly (discussed in more detail below) of the pump 10 and is not in communication with the engine oil (not shown). However, it will be appreciated that oil 46 may be in communication with the engine oil through a passage (not shown) to the engine. A suitable pressure regulator (not shown) may be employed in order to reduce the pressure variations in the engine oil. It is not preferable that the oil 46 be in communication with the engine oil as, e.g., additives for neutralizing acidity required in engine oil are unnecessary for the pump 10. In addition, the viscosity of oil 46 may be less than that of engine oil.

The shuttle 107 is generally cylindrical in shape and may be composed of any suitably strong and moldable material such as a plastic, preferably a nylon or acetal resin such as that sold under the trademark DELRIN, sold by DuPont de Nemours, E.I., Co. Wilmington, Del. The shuttle may include tapered end portions 113 and at least one seal but preferably comprises a pair of O-rings 114 mounted within recesses 120. The shuttle 107 is moveably disposed within the longitudinal bore 106 such that the pressure associated with the fuel 22 (approximately 2–5 bar) may be balanced or equalized with the pressure of the lube oil 46. For example, if the pressure of the lube oil 46 is greater than that of the fuel 22, the shuttle 107 will be urged toward the fuel 22 and vice versa. The term pressure differences as used herein refers to pressure levels between fluids which arise because of, for example, volumetric changes, in particular, the effects of volume changes due to variations in thermal expansion.

As can be seen, seal 42' includes lube oil 46 disposed on one side thereof and fuel 22 disposed on the opposite side. Since the shuttle 107 generally equalizes pressure on either side of the seal 42', the seal 42' is prevented from being canted in one direction (arrow 115) or the other (arrow 115') due to a substantial difference in pressure.

In accordance with another feature of the present invention, a spring 116 having an enlarged diametrical portion 117 is mounted in a recess 118 of the open end 110 of the longitudinal bore 106. The spring 116 functions to bias the shuttle in the direction of oil 46, thereby increasing the pressure of the oil 46 relative to that of the fuel 22. A suitable force provided by the spring 116 ranges from approximately 0.05 lbs to 0.15 lbs and is preferably approximately 0.1 lbs whereby the pressure difference between the oil 46 and fuel 22 ranges from about 1.0 psi to 3.0 psi and is preferably approximately 2.0 psi. Because of this pressure difference, it is more likely that oil 46 will mix slightly with the fuel 22 through, for example, seal 42' rather than, the opposite occurring. As discussed above, while it is most desirable that no mixing occur between the fluids it is less desirable that fuel mixes with oil rather than vice versa as problems such as the loss in lubricity of the oil may occur.

It will be understood that the dimension between the O-rings 114 may be arranged such that neither O-ring passes over the portion of the bore 106 passed over by the other given the amount of travel within the bore 106 that the shuttle 107 undergoes. By limiting contact by the O-rings 114 to only a particular fluid, the sealing of the shuttle is increased while the likelihood of mixing of fuel 22 and lube oil 46 is reduced.

In anticipation of assembly of the rotatable shaft 30, with the pump 10, the bore 106 is preferably pre-filled with an appropriate quantity of oil 46 and thereafter the shuttle 107 is inserted into the bore. Optionally, spring 116 may then be inserted into bore 106 which, in addition to the function discussed above, also functions to prevent loss of oil 46 through the bore 106.

Another embodiment of a shuttle useable in the practice of the present invention is illustrated generally at 207 in FIG.

2. In this embodiment the shuttle 207 may be generally cylindrical in shape as the prior embodiment, although rather than employing O-rings the sealing of the shuttle may be arranged at opposing ends 208 and 210 of the shuttle. In order to provide a seal, each end 208, 210 are dimpled leaving an outer tapered rim 212 and 214. Each tapered rim 212, 214 provides, as will be appreciated, a sealing characteristic adjacent the inner surface 216 of the bore 206. The shuttle is composed of a sufficiently durable and flexible material such as a plastic material, for example, nylon. It will be understood that while no bias means for biasing the shuttle is illustrated, one may also be employed in connection with this embodiment.

Figure 3:
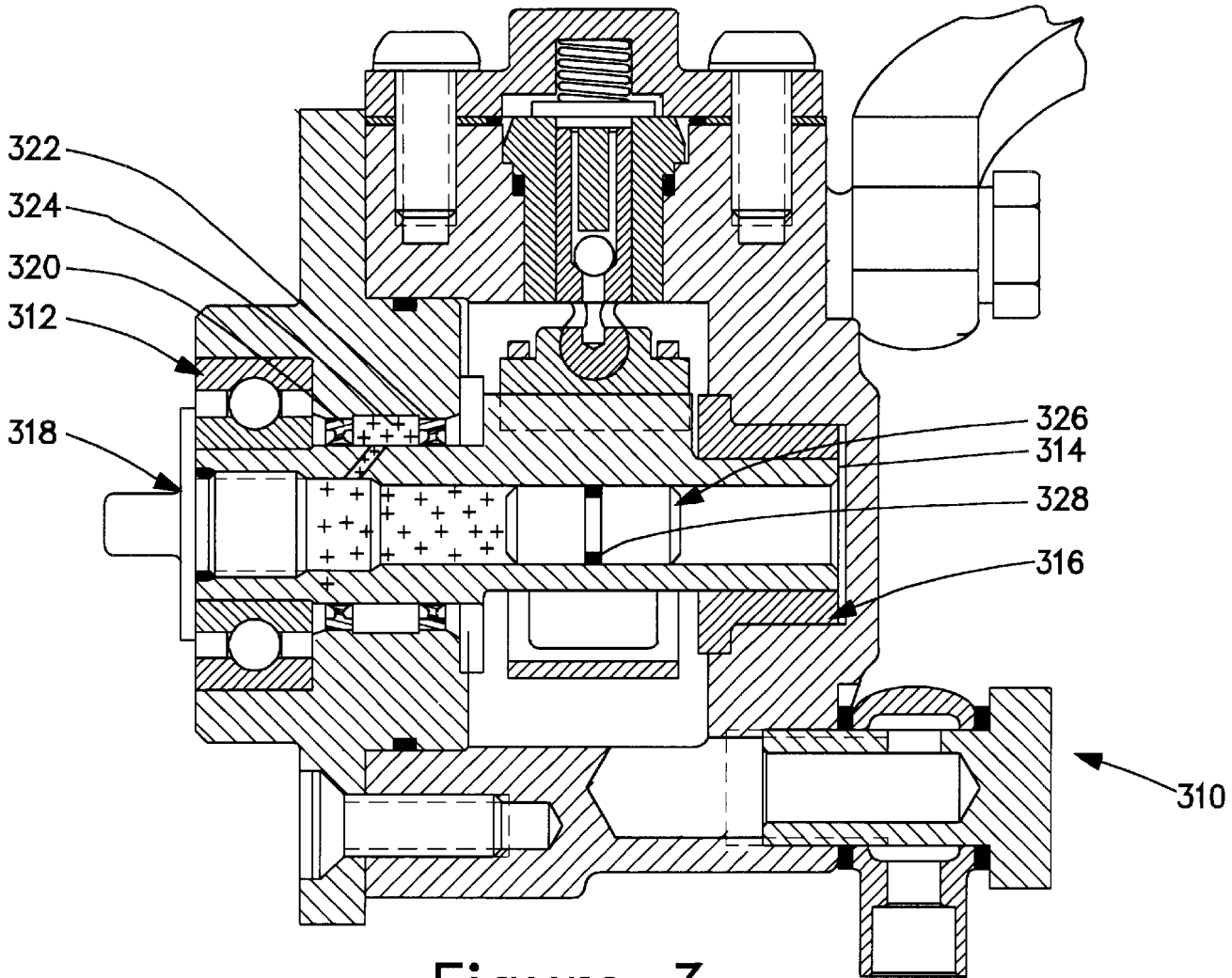
FIG. 3 is a cross sectional view of a pump having a ball bearing scheme and employing a pressure equalizing shuttle in accordance with a further embodiment of the present invention.

Turning now to FIG. 3, another embodiment of a pump used in practice of the present invention is shown generally at 310. In this embodiment, the pump 310 comprises a ball bearing and bushing rather than needle bearings as provided in the embodiment of FIG. 1. In particular, a ball bearing 312 is provided for the rotatable shaft 314 along with a wet bushing 316.

An enlarged tang 318 is provided for covering the outer portion of the bearing 312. In addition, seals 320 and 322 are separated by an oil reservoir 324.

Figure 2:
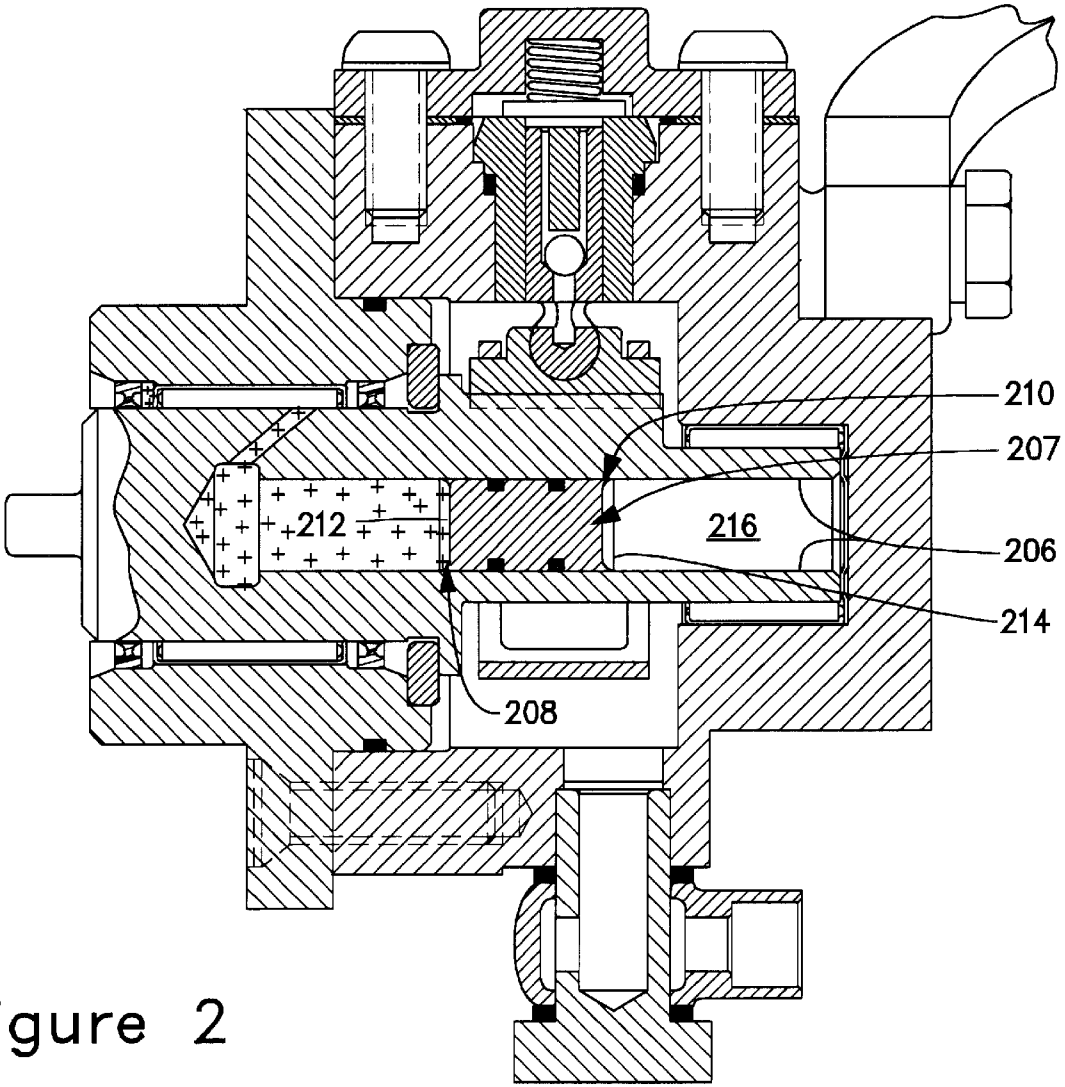
FIG. 2 is a cross sectional view of a pump having a needle bearing scheme and employing a pressure equalizing shuttle in accordance with another embodiment of the present invention.

A shuttle 326 is provided which may be similar to that discussed above, with respect to FIG. 1, although as illustrated only one O-ring 328 is provided. It will be understood that while only one O-ring is illustrated in this embodiment, the shuttle 326 may include a par of O-rings. It will also be understood that while no spring for biasing the shuttle is illustrated, any suitable bias may be employed in connection with this embodiment. It will also be understood that the present bearings scheme of FIG. 3 may be employed in combination with the shuttle 207 illustrated in FIG. 2.

Figure 4:
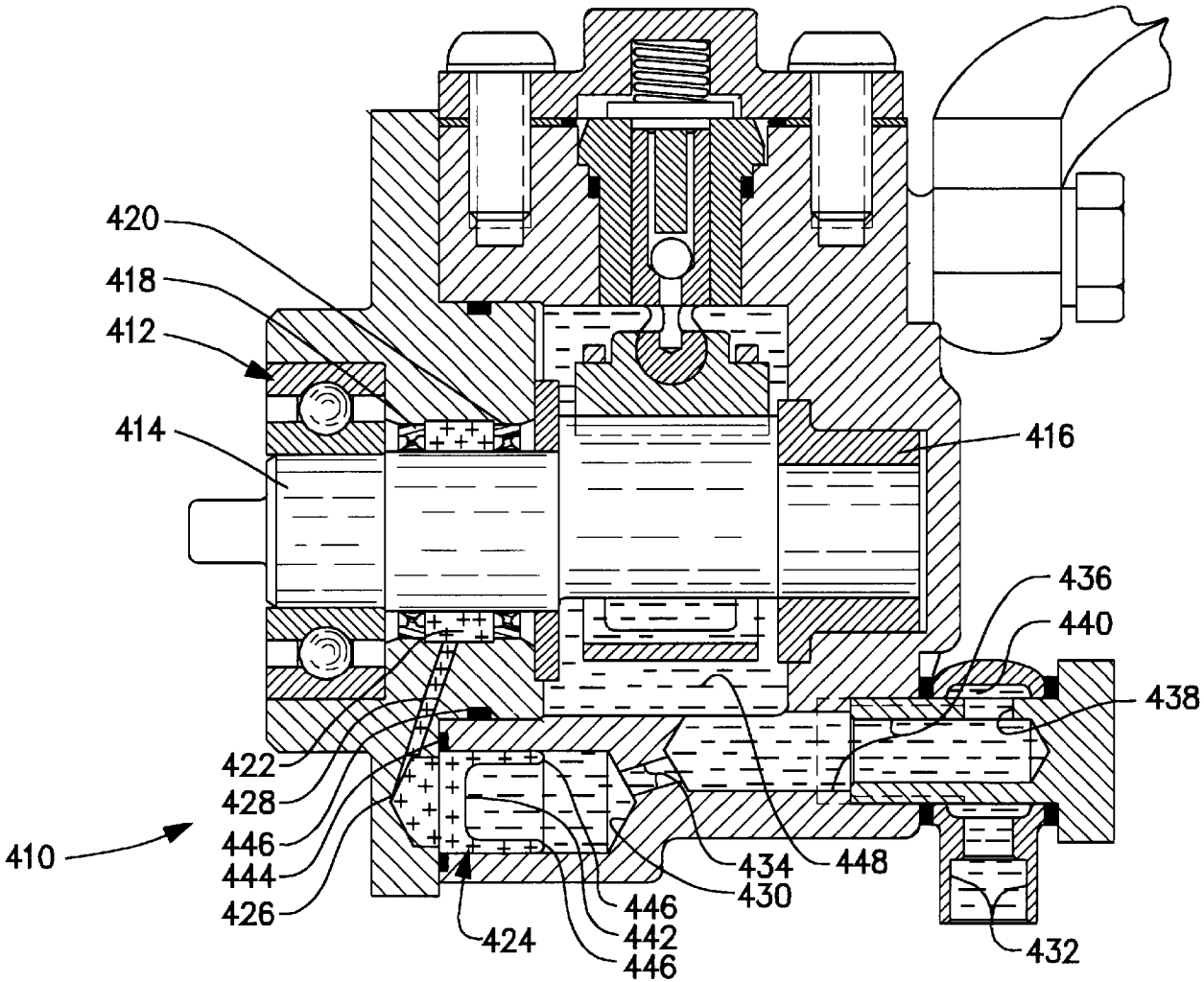
FIG. 4 is a cross sectional view of a pump having a ball bearing scheme and employing a diaphragm in accordance with still a further embodiment of the present invention.

Still another embodiment of a pump in accordance with the present invention is illustrated generally at 410 in FIG. 4. In this embodiment of the invention, an equalizing element is provided which comprises a flexible diaphragm, discussed in more detail below, instead of a shuttle as described above. As illustrated, the pump 410 comprises a first bearing 412, a rotatable shaft 414 and a second bearing 416. A pair of seals 418 and 420 are provided which assist in preventing outward migration of lubricating fluid such as oil 422 disposed in a channel 423 located between the seals and about the rotating shaft 414.

An oil/fuel pressure interface chamber is located at 424. One end 426 of the interface chamber 424 communicates with a passage 428 which, in turn, communicates with the channel 423. The other end 430 of the interface chamber 424 communicates with fuel inlet 432 via intermediate passages 434, 436, 438 and annulus 440.

A flexible diaphragm 442 may be centrally located within the interface chamber 424. The diaphragm 442 may be composed of any suitably flexible material such as a synthetic rubber and may be mounted within the chamber 424 via a mounting rib 444. The diaphragm 442 may be dimensioned to be substantially larger than a cross sectional area of the chamber 424 whereby fold 446 may occur. During use, the folds 446 may fold or unfold so that the center (not numbered) of the diaphragm 442 may move within the inside of the chamber 424.

Similar to the shuttles 107 and 207 discussed above in connection with FIGS. 1 and 2, the flexible diaphragm 442 is movable based on, e.g., differences in the coeficient of thermal expansion which creates volume changes and, in turn, pressure variations between the oil 422 and fuel 448 disposed within the pump 410. Accordingly, the diaphragm 442 equalizes the pressure between the oil 422 and fuel 448 which, e.g., reduces the likelihood of mixing of the two such as by passing seal 420 in a manner similar to that discussed above.

While the present invention has been described in connection with what is presently considered to be the most practical and preferred embodiments, it is to be understood that the present invention is not limited to the disclosed embodiments. Rather, it is intended to cover all of the various modifications and equivalent arrangements included within the spirit and scope of the appended claims.

What is claimed is:

1. An apparatus for equalizing pressure between a first region of lubrication fluid for lubricating the pump and a second region of combustion fluid at a low pressure, the pump having a rotatable shaft, the apparatus comprising:

a wall defining a bore disposed within the pump, a first end of said bore being configured to be in fluid communication with said first region and a second end of said bore being configured to be in fluid communication with said second region; and an equalizing element disposed within said bore, said equalizing element separating the lubrication fluid and the combustion fluid and being at least partially movable in response to pressure differences between the first region and the second region.

2. The apparatus of claim 1 wherein the equalizing element comprises a shuttle.

3. The apparatus of claim 1 wherein the equalizing element comprises a diaphragm.

4. The apparatus of claim 2 further comprising:

means for biasing said shuttle against the lubrication fluid in the bore so as to increase the pressure of the lubrication fluid in the first region relative to the combustion fluid in the second region.

5. The apparatus of claim 4 wherein:

the bore is disposed within the rotating shaft and the rotating shaft includes a recess which communicates with said bore; and said biasing means comprises a coil spring having an enlarged diameter portion at one end thereof, wherein the enlarged diameter portion is disposed within the recess.

6. The apparatus of claim 4 wherein at least one seal is disposed on the shuttle for sliding against said wall means.

7. The apparatus of claim 4 wherein the at least one seal comprises a pair of lip seals disposed at opposing ends of the shuttle.

8. The apparatus of claim 6 wherein the shuttle includes a pair of recesses laterally spaced along a longitudinal axis of the shuttle and the at least one seal comprises two O-rings each of which are mountable within a respective recess of the shuttle.

9. The apparatus of claim 8 wherein the axial length of the bore and the spacing of the recesses of the shuttle are dimensioned such that during movement of the shuttle each respective O-ring engages only that portion of the bore in contact with a respective lubrication fluid or combustion fluid.

10. The apparatus of claim 9 wherein the shuttle is generally cylindrical in shape.

11. The apparatus of claim 4 wherein:

the pump comprises a pump housing and the rotatable shaft is disposed within a pump cavity of the pump housing; and a first bearing and a second bearing are interposed between the rotatable shaft and the pump housing, the first bearing being situated in the first region of lubrication fluid and the second bearing being situated in the second region of combustion fluid.

12. The apparatus of claim 11, wherein said first and second bearings comprise needle bearings.

13. The apparatus of claim 11, wherein said first bearing comprises a ball bearing and said second bearing comprises a wet bushing.

14. The apparatus of claim 3 wherein said diaphragm comprises a mounting rib.

15. The apparatus of claim 14 wherein said diaphragm is dimensioned to be substantially larger than the cross sectional area of the bore.

16. The apparatus of claim 11 wherein:

the rotatable shaft has an external profile;

the pump supplies the combustion fluid at relatively high pressure to a common rail and the pump further comprises:

at least one shoe means in sliding engagement with the external profile of the rotatable shaft;

retention means for urging said shoe means against the external profile of the rotatable shaft during rotation thereof;

at least one pumping plunger disposed in a plunger bore and being in operative engagement with said shoe means, each of said plungers having radially outer and inner ends relative to said axis and an internal charging passage which opens toward the cavity at the inner end of the plunger and opens toward the outer end of the plunger bore at the outer end of the plunger, said shoe means sliding on said external profile which is configured for providing reciprocal movement of said plungers;

a discharge passage from the outer end of the plunger bore into the housing, and a discharge check valve in said discharge passage for permitting flow only away from said plunger bore, said discharge passage communicating with said common rail;

whereby reciprocation of each plunger includes movement toward an inner limit position for inducing a low pressure in the outer end of the plunger bore, thereby drawing combustion fluid in a charging phase of operation from the pump cavity through said charging passage into the outer end of the plunger bore, and movement toward an outer limit position for developing a high pressure in the outer end of the plunger bore, thereby discharging combustion fluid through said discharge check valve into said common rail in a discharging phase of operation.

17. The apparatus of claim 16, wherein the charging passage includes a charging check valve which is normally closed at said inner end, but which opens to permit flow from the inner to the outer end of the plunger during said charging phase of operation.

18. The apparatus of claim 16, wherein the lubrication fluid comprises a lubricating oil and the combustion fluid comprises gasoline.

19. An apparatus for equalizing pressure between a lubrication fluid for lubricating a pump and a combustion fluid located at a low pressure side of the pump, the apparatus comprising:

a wall defining a bore disposed within the pump, a first end of said bore being configured to receive lubrication fluid and a second end of said bore being configured to receive combustion fluid; and a shuttle disposed within said bore, said shuttle separating the lubrication fluid and the combustion fluid and being movable in response to pressure differences between the lubricating fluid and the combustion fluid.

20. In a pump for receiving combustion fluid at low pressure and supplying combustion fluid at high pressure, apparatus for equalizing pressure between a first region of lubrication fluid for lubricating the pump and a second region of combustion fluid at a low pressure, the pump having a rotatable shaft, the apparatus comprising:

wall means defining a bore disposed within the rotatable shaft, a first end of said bore being configured to be in fluid communication with said first region and a second end of said bore being configured to be in fluid communication with said second region; and a shuttle disposed within said bore, said shuttle being configured to equalize pressure between the first region and the second region.

21. The apparatus of claim 20 further comprising:

means for biasing said shuttle against the lubrication fluid in the bore so as to increase the pressure of the lubrication fluid in the first region relative to the combustion fluid in the second region.

22. The apparatus of claim 21 further comprising a seal disposed about the rotatable shaft, wherein said seal is disposed between the first region and the second region.

23. The apparatus of claim 22 wherein said first region comprises:

a passage communicating with said chamber at one end, passing through the shaft and communicating at the other end with one side of said seal.

24. The apparatus of claim 23 wherein said second region comprises a main cavity which communicates with another side of said seal.

* * * * *